United States Patent [19]

Jensen

[11] Patent Number: 5,005,619

[45] Date of Patent: Apr. 9, 1991

[54] FINGER JOINT CUTTER HEAD

[75] Inventor: Raliegh J. Jensen, Boise, Id.

[73] Assignee: Ace Company, Inc., Boise, Id.

[21] Appl. No.: 477,481

[22] Filed: Feb. 9, 1990

[51] Int. Cl.[5] ..... B27G 13/00

[52] U.S. Cl. ..... 144/230; 144/36; 144/90 A; 144/231

[58] Field of Search ..... 144/39, 40, 41, 42, 144/43, 90 R, 90 A, 91, 36, 37, 218, 230, 229, 231

[56] References Cited

U.S. PATENT DOCUMENTS

| | | | |
|---|---|---|---|
| 362,625 | 5/1887 | Hewit | 144/37 |
| 1,099,880 | 6/1914 | Kendall | 144/90 A |
| 1,265,501 | 5/1918 | Payzant | 144/90 A |
| 1,903,002 | 3/1933 | Johnson | 144/222 |
| 2,449,605 | 9/1948 | Kelton | 144/41 U X |
| 3,807,096 | 4/1974 | Tackett | 51/40 |
| 3,951,189 | 4/1976 | Cromeens | 144/91 |

*Primary Examiner*—W. Donald Bray

*Attorney, Agent, or Firm*—Robert A. de Groot; Stephen A. Gratton

[57] ABSTRACT

A combination finger joint cutter head having a pair of adjustable cutter assemblies, that cut a plurality of finger joints in an end of a wood piece, and a pair of adjustable trim knives, wherein a single adjusting means extends or retracts the pair of knives, thereby changing the finger joint length slightly to either loosen or tighten the joint.

3 Claims, 10 Drawing Sheets

FINGER JOINT CUTTER HEAD

BACKGROUND OF THE INVENTION

This invention relates to a combination finger joint cutter head mounted on a rotatable shaper spindle such that the cutter head cuts finger joints and trims the joints in a piece of wood. Cooperating finger joint cuts may be made such that pieces of wood or other material may be joined together. Finger joint cutting is an economical process to produce a long piece of wood from a number of short pieces of wood by providing matching or cooperating surfaces at the ends of the wooden pieces that can be fitted together and then glued.

Present processes for profiling the ends of wood pieces are disclosed in U.S. Pat. No. 3,807,096, issued Apr. 30, 1974, wherein the apparatus disclosed produces matching finger joints by means of a pair of opposing abrasive profiling cutters that alternately cut from the edge to the center at the ends of the wood. The apparatus includes a wood positioning device so that the profile cutters need not be relocated for subsequent cuts. The depth of the cut is limited by the tool profile.

More recently the industry has developed a deeper tooth finger joint of a trapezoidal shape that is cut using a stack of cutter blades and interposing spacers between the blades as needed, to obtain the deeper cut fingers. Such cutter blade heads do not trim the ends of the wood fingers-a separate knife cutting blade head or saw must be used for end trimming. Because the end cutting and finger joint cutting are separate processes, the possibility of improper end trimming relative to finger joint cutting is increased.

Finger jointing requires extremely precise cutting of the trapezoidal tooth profiles in order to properly mate the fingers of one piece of the cavity portions of a mated piece. Improper cutting results in a poor fit, which forms a piece having decreased joint strength after mating and gluing. It is important that the depth of the tooth be such that the tips of the mating teeth do not bottom out in the mating cavity since this would result in gaps along the sides of each tooth and consequent poor bonding. Conversely, if the tooth is cut too short, a gap at the tip of each tooth results, again reducing the bonding strength. Thus it can be seen that consistent and precise end trimming is an important step in the finger jointing process.

Adjustment of prior art finger joint trim knives is difficult to accomplish with any degree of certainty as to the amount of adjustment effected.

It is the purpose of this invention to provide a finger joint cutter head with an easy, vernier adjustment mechanism permitting contraction and extention of straight trim knives simultaneously with a single adjustment. More substantial adjustment of the finger joint cut depths requires removal of a cutter head top plate and cutter blades to interpose the spacers between the blades. Such mechanism permits adjustment more quickly and accurately than possible with prior art devices, resulting in a more precise finger joint cut. In a preferred embodiment, vernier adjustment of the device can be made while the finger joint cutter head is mounted on the spindle.

SUMMARY OF THE INVENTION

The present invention combines a plurality of stacked cutter blade assemblies with adjustable trim knives on a common cutter head. In a preferred embodiment, the present invention includes a trim knife adjustment apparatus that adjusts all the trim knives at once by turning a single adjustment screw on the side of the cutter head. The adjustment is accomplished without removing the cutter head from the shaper spindle (the shaft that provides rotary motion to the cutter head). Following adjustment of the trim knives, they can be secured in a fixed position by tightening screws located adjacent the knives.

The length of the individual fingers of a finger joint are adjusted by interposing spacers or shims between each of the removable cutter blades in the cutter head assembly. The number of blades in the cutter assembly can vary from about 4 to about 15 depending on the thickness of the wood. The individual cutter blades are typically about ⅛ inch in thickness with a bottom cutter blade that is about ¼ inch in thickness. A plurality of cutter blades are stacked one on top of the other, with each cutter blade having an aperture therethrough, to which a fastening bolt is inserted to securely affix the stacked cutter blade assembly to a cutter head body portion.

Cutter blades and trim knives are sharpened by grinding the flat face of each to be parallel to the axis of the cutter head using a grinding wheel.

DETAILED DESCRIPTION OF THE INVENTION

Figure 1:
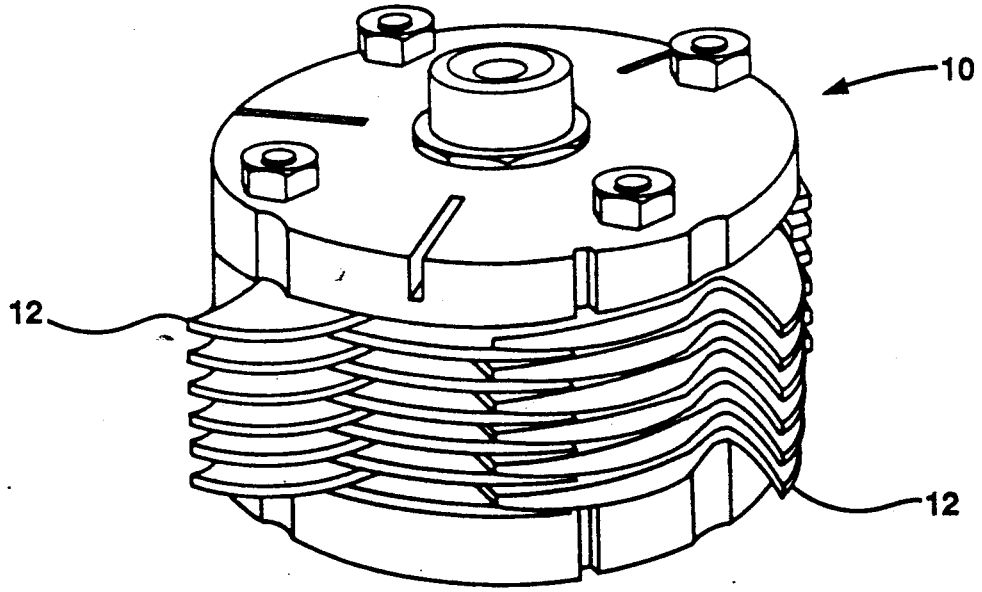
FIGURE 1 (PRIOR ART)
FIG. 1 is a perspective view of a prior art finger joint cutter head.

FIG. 1 illustrates a four-bolt finger joint cutter head 10 having four stacks of cutter blades 12, used in the wood products industry for many years. The apparatus of FIG. 1 merely cuts the individual fingers, as a separate process trims the fingers to the appropriate length.

Figure 2:
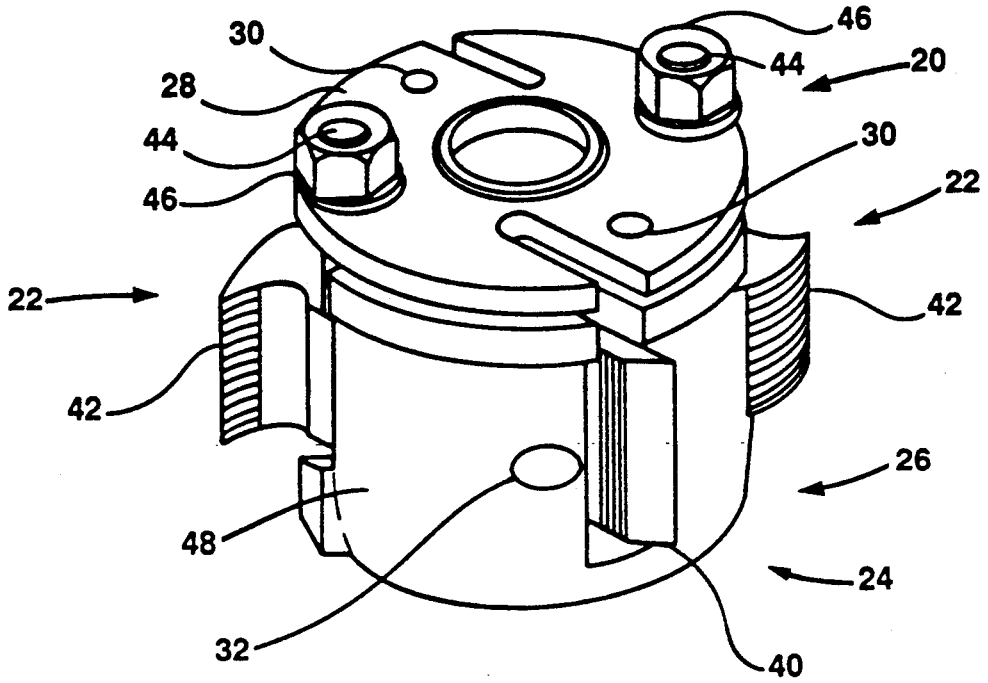
FIG. 2 is a in perspective view of the finger joint cutter head of the present invention.

A two-bolt combination finger joint cutter head 20 of the present invention is illustrated in FIG. 2, wherein a pair of cutter head assemblies 22 are bolted by bolts 44 to body portion 26. Top plate 28 is provided with a pair of apertures 30 which provide access to tighten the trim knife assemblies 24 as described in greater detail below. Side aperture 32 in body portion 26 provides access to trim knife adjustment screw which adjusts the trim knives for proper finger joint length. A plurality of cutter blades 42 are securely clamped between top plate 28 and body portion 26 by finger joint bolts 44 and finger joint nuts 46. Cover plate 48, illustrated directly beneath top plate 28 is secured between cover plate 48 and body portion 26.

Figure 3:
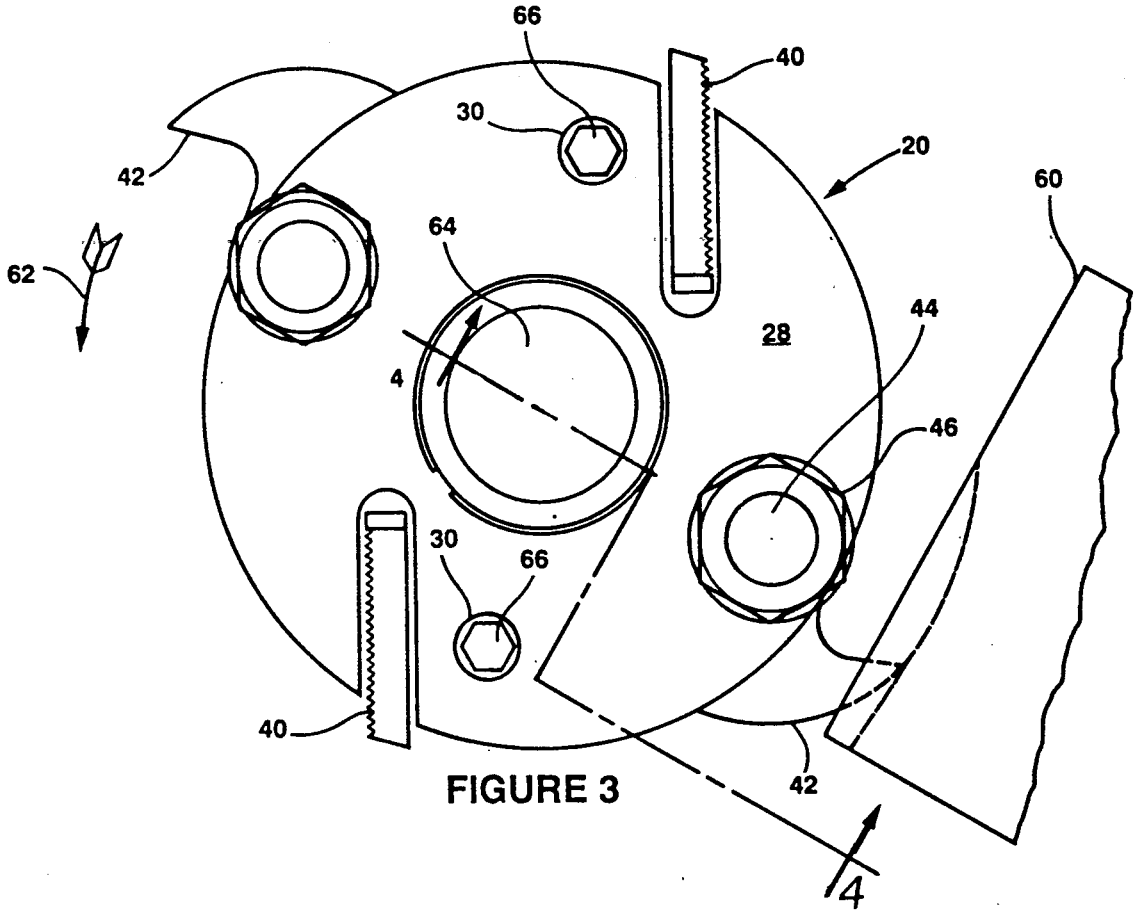
FIG. 3 is a plan view of the top of the finger joint cutter head of the present invention.

FIG. 3 illustrates, in plan view, the cutter head 20 as the blades 42 cut through a wood piece 60, while rotating in the direction of arrow 62 about spindle 64. As described hereinafter, the top plate apertures 30 provide access to the threaded wedge fasteners 66.

Figure 4:
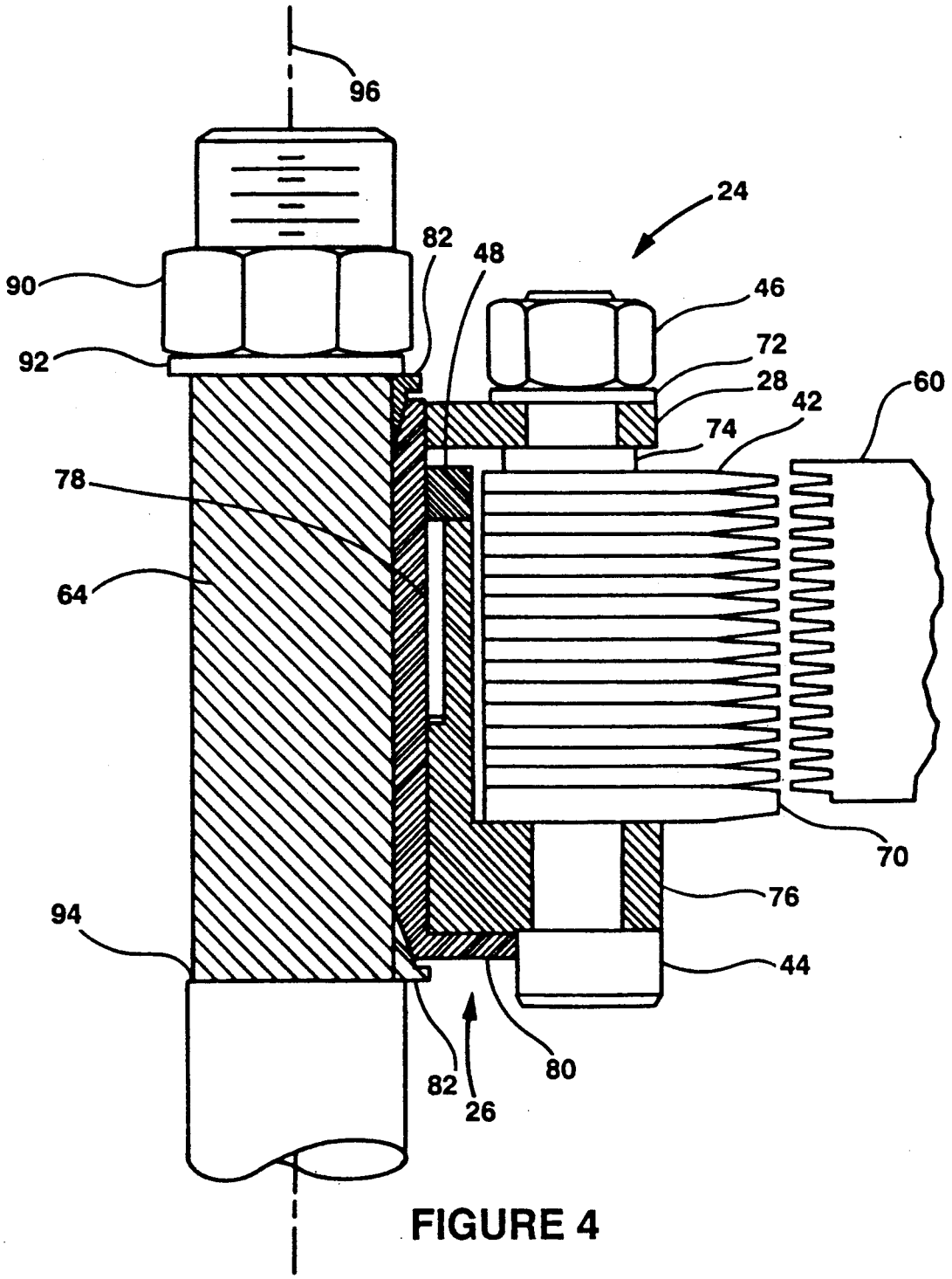
FIG. 4 is a partial sectional view taken along lines 4—4 of FIG. 3.
Figure 5:
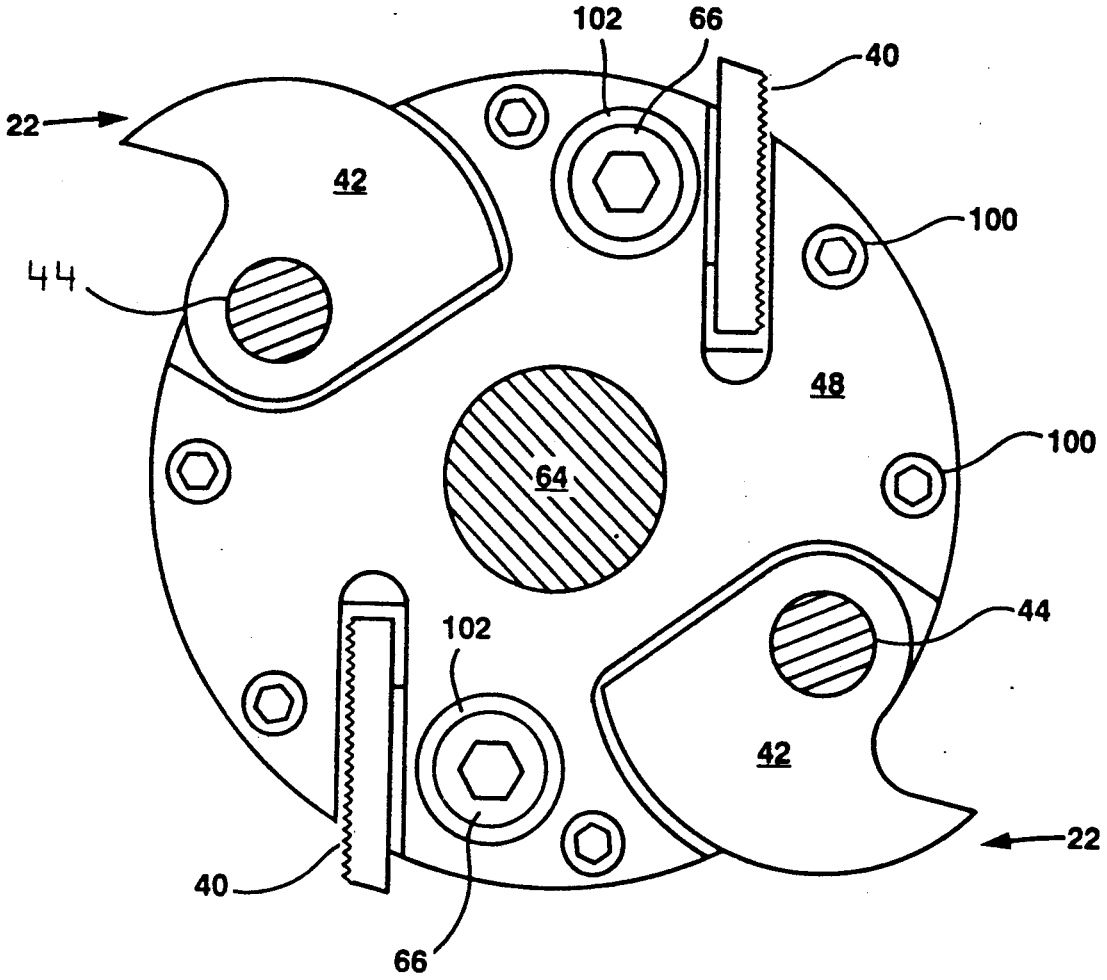
FIG. 5 is a plan view of the cutter head assembly of the present invention with the top plate removed.

As illustrated in FIGS. 4 and 5, the cutter head assembly 22 is bolted to body portion 26, which is in turn clamped to spindle 64. The cutter head assembly comprises a plurality of removable and replaceable individual cutter blades 42, equal in number to the desired number of fingers to be cut in the wood piece 60. The assembly 22 may be provided with a thick bottom cutter blade 70, washer 72, and spacer 74, securely fastened between top plate 28 and body 26 with bolt 44 and nut 46. The body 26 and rotary cylinder 78 are slipped over bushing 80, which is retained by upper and lower wedge-shaped collets 82. The collets 82 are compressed in place by spindle nut 90 and spindle washer 92. The lower collet is compressed against shoulder 94. Body portion 26 freely rotates about an axis of rotation 96.

A plurality of cover plate cap screws 100, retain the cover plate 48 against body portion 26. The heads of wedge cap screws 66 are illustrated bearing on wedge-shaped members 102 (FIG. 7).

Figure 6:
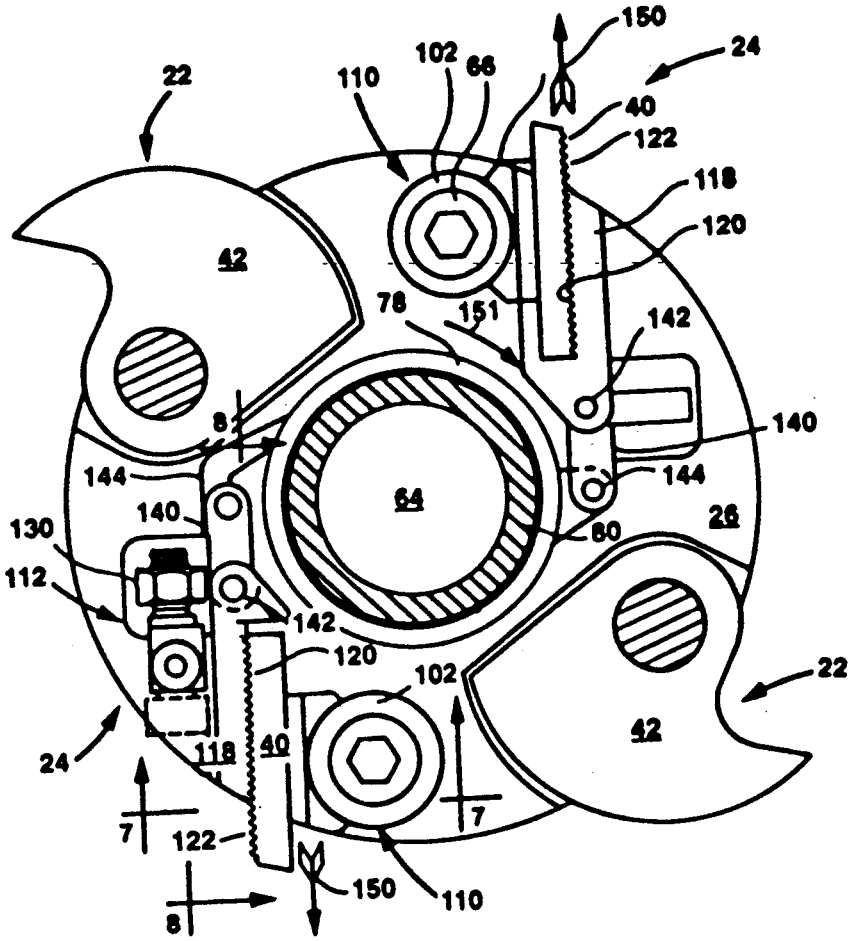
FIG. 6 is a plan view of the cutter head assembly of the present invention with the top plate and the cover plate removed.

Generally, FIG. 6 is a plan view of the body portion below the cover plate, and illustrates the relationship between the cutter assemblies 22 and the trim knife assemblies 24. The individual trim knives 40 are secured to the body with a pair of knife clamp apparatus' 110, illustrated in greater detail in FIG. 7.

Figure 7:
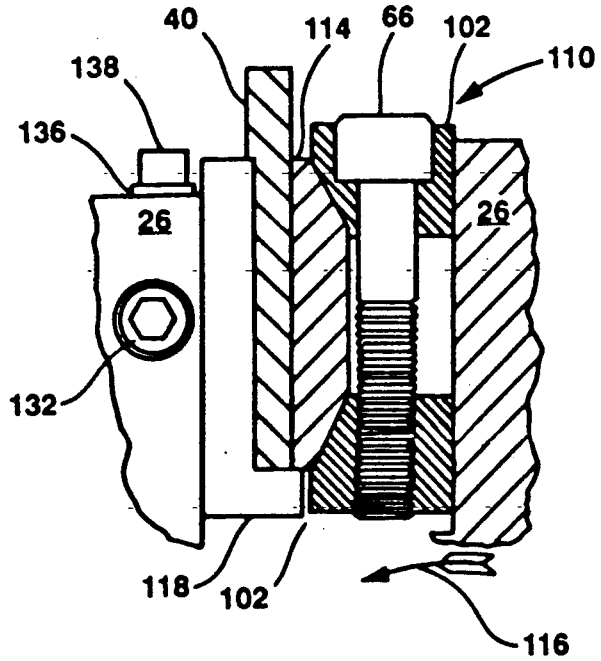
FIG. 7 is a partial sectional view taken along lines 7—7 of FIG. 6.

Referring to FIG. 7, in a preferred embodiment the knife clamp apparatus 110 comprises four parts: the wedge cap screw 66, the upper and lower wedge-shaped members 102 and a thrust plate 114. Tightening the cap screw 66 creates a compressive force (shown by arrow 116) on the thrust plate 114, which in turn presses trim knife 40 and knife holder 118 against the body 26. Horizontal relative motion between the knife 40 and knife holder 118 is prevented by a corrugated surface 120 on the knife holder 118 and a cooperating corrugated surface 122 on the knife 40 (FIG. 6).

Figure 8:
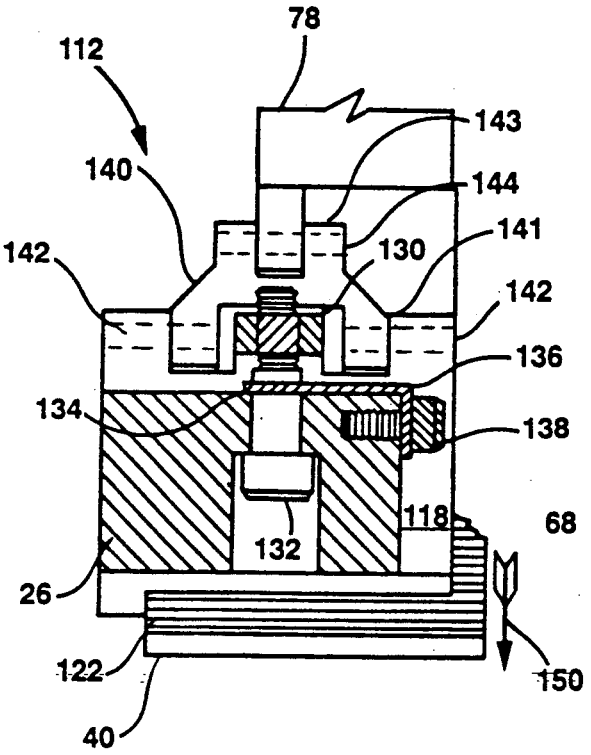
FIG. 8 is a partial sectional view taken along lines 8—8 of FIG. 6.

Referring to FIG. 8, the knife adjustment apparatus 112 comprises the knife holder 118 having a threaded tab 130 threadably engaged with a knife fastener 132. The fastener 132 may be in the form of a cap screw having a reduced section 134 into which retainer 136 is inserted. A retainer cap screw 138 fixes the retainer to the body 26. A link 140 has a first end 141 pivotally connected to the knife holder 118 by link pins 142, and a second end 143 pivotally connected to the rotary cylinder 78 by cylinder pin 144.

After loosening knife clamp apparatus 110 by loosening wedge cap screws 66 with an Allen wrench, rotation of knife fastener 132 (cap screw) causes linear motion as shown by arrow 150, of both trim knives 40 and knife holders 118 due to rotary motion (shown by arrow 151 in FIG. 6) of the rotary cylinder 78 and connecting links 140.

Figure 9:
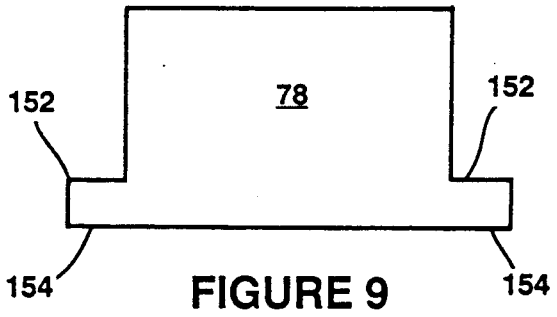
FIG. 9 is an elevation view of the rotary cylinder.
Figure 10:
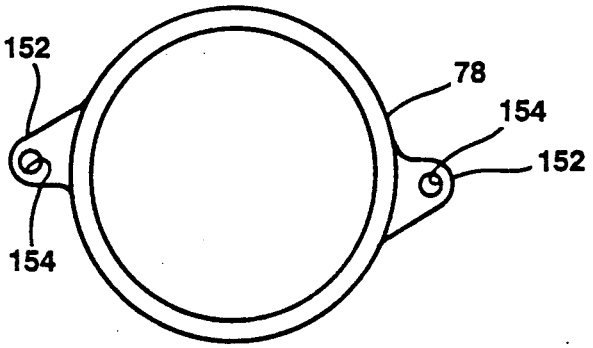
FIG. 10 is a plan view of the rotary cylinder.
Figure 14:
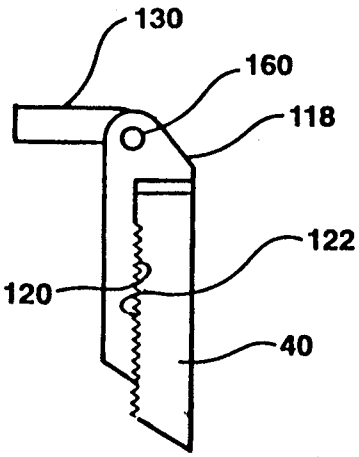
FIG. 14 is a top view of the knife holder.
Figure 13:
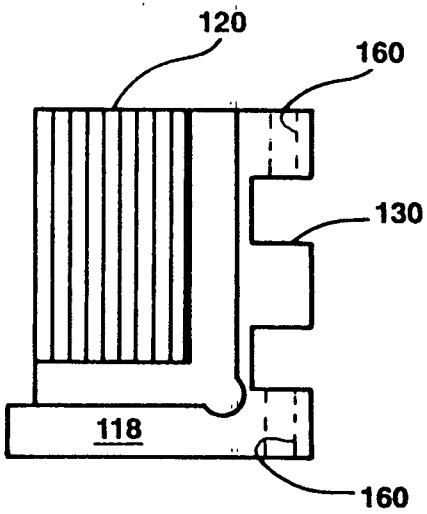
FIG. 13 is a back elevation of the knife holder.
Figure 12:
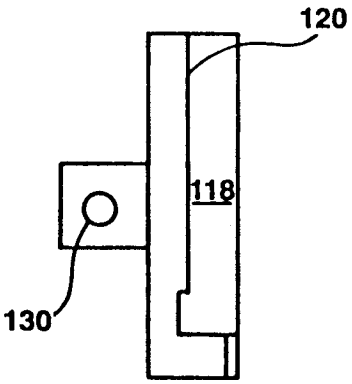
FIG. 12 is a side elevation of the knife holder.
Figure 11:
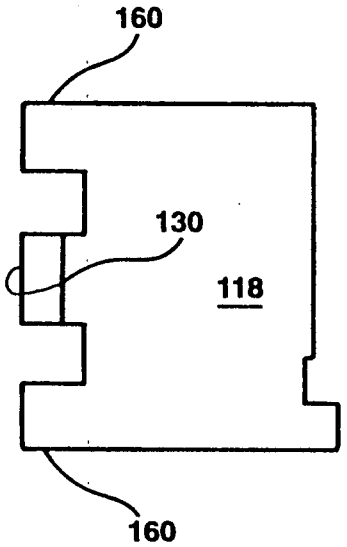
FIG. 11 is a front elevation of the knife holder.

FIGS. 9 and 10 illustrate the rotary cylinder 78 and extension arms 152 having apertures 154 for the pivotally connecting links 140 and the link pins 144.

FIGS. 11 through 14 illustrate the knife holder. Corrugated surface 120 is securely maintained against the cooperating corrugated surface 122 on the trim knife 40. Threaded tab 130, which is engaged by knife fastener 132 (FIG. 8), imparts linear motion to both knives 40 and knife holders 118. In-line bored apertures 160 are pivotally engaged by the link pins 142 to the link 140.

The apparatus of the present invention can be constructed such that approximately 3/16 inch travel of the adjusting knife fastener 132 provides vernier radial extension of knives 40. Gross (less precise) adjustment of trim knives is accomplished by loosening the knife clamp apparatus 110, disengaging the corrugated surfaces 120 and 122 between trim knife 40 and knife holder 118, and re-engaging the surfaces in a more extended or retracted position. Both knives 40 must be extended an equal number of corrugations in order to assure that both knives trim equally and to avoid excessive wear on one blade that extends radially beyond the other blade.

Figure 15:
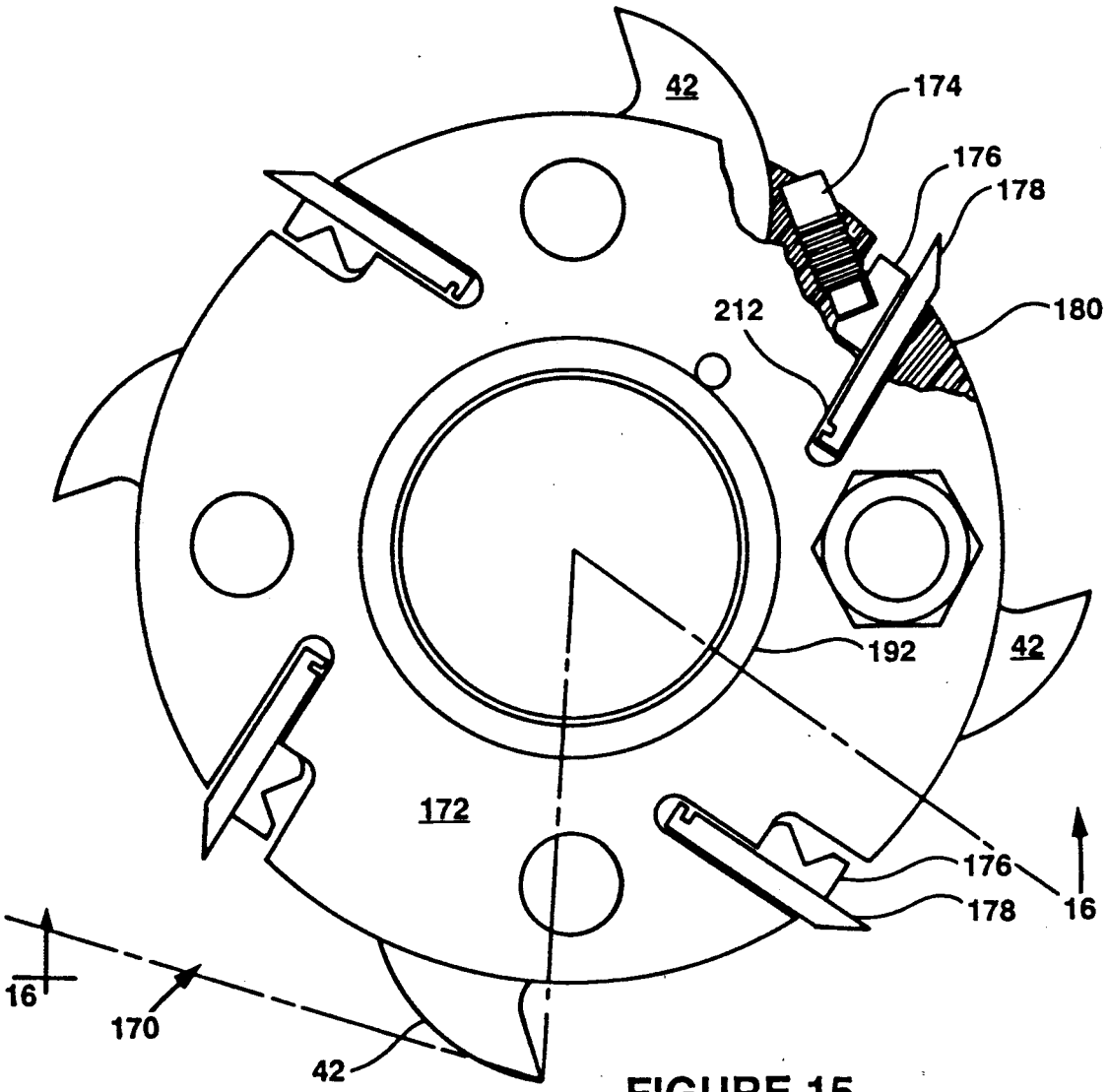
FIG. 15 is a plan view of an embodiment of the cutter head with a partial cutaway section.

In a second embodiment of the present invention, a four-blade and four-knife cutter head assembly 170 is illustrated in FIG. 15. A section of top plate 172 has been cut away to illustrate one of the eight gib screws 174 that bear against a gib 176 that in turn firmly secures the planer knife 178 against body portion 180. The gib screws 174, two per knife, are loosened to allow radial knife adjustment as described below.

Figure 16:
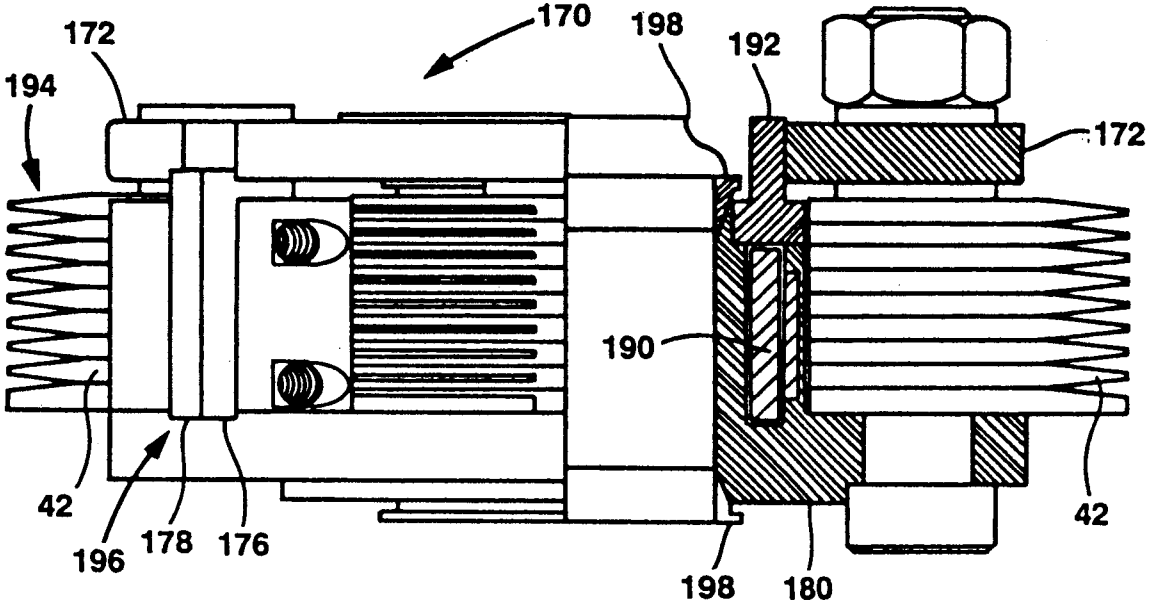
FIG. 16 is a sectional view taken along lines 16—16 of FIG. 15.

An elevation of the four-knife cutter head is illustrated in FIG. 16. The relative locations of the top plate 172, rotary cylinder 190 within body portion 180, cover plate 192, cutter assemblies 194 and trim knife assemblies 196 are shown. As previously described for the two-cutter head, the body portion 180 is affixed to a spindle (not shown) by means of a pair of collets 198.

Figure 17:
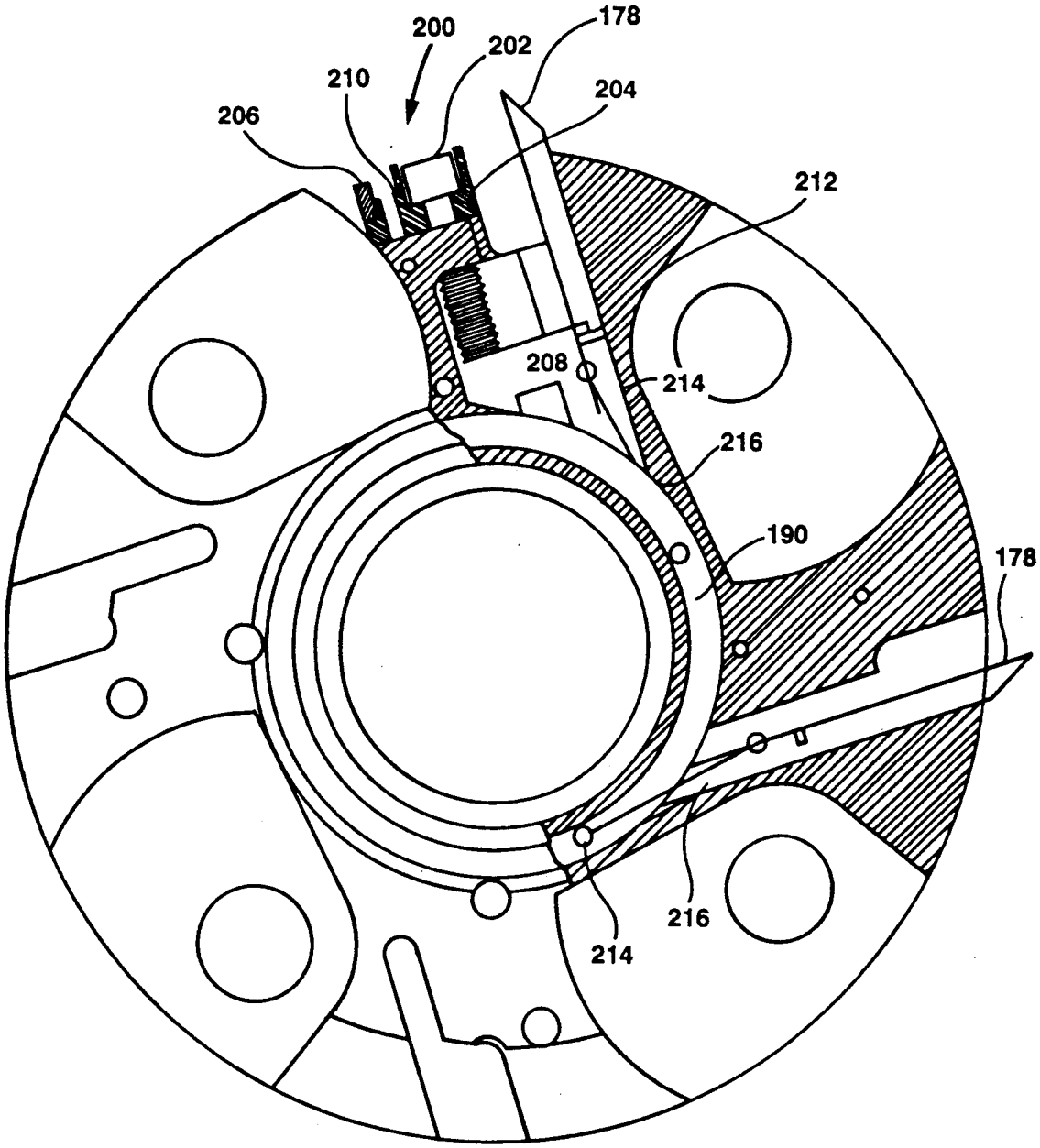
FIG. 17 is a partial section plan view of the embodiment of FIG. 15 with the top plate removed.

The adjustment apparatus 200 of the planer knife 178 (FIG. 15) is illustrated in FIG. 17. The apparatus 200 comprises an adjustment screw 202, bottom clamp 204, top clamp 206 and adjusting knife holder slide 208. Clamps 204 and 206 are held in place by a pair of clamp screws 210 (one of which is shown). The slide 208 grips knife 178 at slot 212 and is attached to link 216 by pin 214. The link 216 is pinned to rotary cylinder 190. Rotary cylinder 190 is linked to the remaining knives by similar links 216 and pins 214 (only one of which is illustrated in FIG. 17).

Radial knife adjustment of the four-knife cutter head is easily accomplished by loosening eight gib screws 174 (two for each knife). The knives are adjusted radially by turning adjustment screw 202. Rotation of screw 202 moves the adjusting knife holder slide 208, the knife 178 and rotary cylinder 218 which automatically effects the same change (either an extension of retraction of) the other three knives by the links 216 at each knife. After setting the knife extension the gib screws 174 are tightened to firmly grip the knives 178 and the gibs 204.

Adjustment of the cutter blades 178 in the embodiment of FIGS. 15–17 is similar to that previously described for the dual knife cutter head assembly.

Although the invention has been described and illustrated herein with either a pair of knife assemblies and cutter assemblies or with four knives and cutter assemblies, it should be readily apparent that a single knife and cutter or more than four knives and cutter assemblies on one cutter head are within the scope of the invention. So long as the cutter head assembly is rotationally balanced, the present invention is susceptible to any member of variants of knife and cutter members. Additionally, the cutter head need not be a circular shape, as any polygon shape, properly balanced, would suffice.

While preferred embodiments of the invention have been disclosed, various modes of carrying out the principles disclosed herein are contemplated as being within the scope of the following claims. Therefore, it is understood that the scope of the invention is not to be limited except as otherwise set forth in the claims.

I claim:

1. A finger joint cutter head assembly comprising:
a. a body portion having an axis of rotation;
b. a pair of diametrically opposed cutter assemblies;
c. a pair of knife clamps having a first and second wedge-shaped member retained by a threaded wedge fastener such that rotation of the wedge fastener causes the wedge-shaped members to bear against a trim knife and securely retain the knife against a first and second knife holder;
d. a knife fastener rotatably retained within the body and threadably engaged with the first and second knife holders such that rotation of the knife fastener extends and retracts the knife holders and engaged knives at the body circumference and wherein the first knife holder is pivotally linked to a rotary cylinder which in turn is pivotally linked to the second knife holder engaging the second knife; and
e. a pair of knife flat surfaces which are corrugated and held in secure contact with a cooperating corrugated flat surface on the knife holders within the body portion of the knife clamp apparatus, and wherein knife extension adjustability beyond the body portion is provided by a horizontal relocation of the knife corrugated surface relative to the corrugated knife holder surface.

2. A finger joint cutter head assembly comprising:
a. a body portion;
b. a pair of cutter assemblies diametrically opposed and affixed to the body portion further comprising:
i. a plurality of removable cutter blades placed in a stacked configuration and having an aperture at an end opposite a cutting edge;
ii. a plurality of spacers interposed between the blades, having an aperture therethrough; and
iii. fastener means inserted through the blade apertures and interposed spacer apertures to adjustably affix the blades to the body portion;
c. a pair of adjustable trim knife assemblies diametrically opposed and affixed to the body portion further comprising:
i. a trim knife adjustment apparatus; and
ii. a knife clamp apparatus, and wherein the trim knife adjustment apparatus consists of:
(a) a pair of trim knife holders having a threaded tab;
(b) a pair of links pivotally connecting the trim knife holders to a rotary cylinder; and
(c) a knife fastener threadably engaged with one of the trim holder threaded tabs, and retained within an aperture in the body portion, such that rotation of the knife fastener extends or retracts the knife holders; and
d. means to securely affix the body portion to a rotatable machine spindle.

3. A finger joint cutter head assembly comprising:
a. a body portion having an axis of rotation;
b. a set of four cutter assemblies;
c. a set of four adjustable trim knife assemblies interposed between the four cutter assemblies consisting of:
i. an adjustment screw threadably engaging in adjustable knife holder slide;
ii. a link pinned to the knife holder slide and a rotary cylinder;
iii. three additional knife holder slides pinned to the rotary cylinder by three links;
iv. four knives engaging with the knife holder slides, such that rotation of the adjustment screw extends and retracts the knives and knife holders from the body portion; and
v. a plurality of knife clamp means further comprising a plurality of gibs and gib screws;
vi. an upper and lower clamp affixing the adjustable knife holder within the body portion by fastener means; and
d. means to securely affix the body portion to a rotatable machine spindle.

* * * * *